United States Patent [19]

Roos et al.

[11] 3,980,144

[45] Sept. 14, 1976

[54] ROCK DRILL FEED MECHANISM

[75] Inventors: Henry H. Roos, Dallas, Tex.; Clarence O. Boom, Littleton, Colo.

[73] Assignee: Gardner-Denver Company, Dallas, Tex.

[22] Filed: Aug. 8, 1975

[21] Appl. No.: 603,207

Related U.S. Application Data

[63] Continuation of Ser. No. 479,913, June 17, 1974.

[52] U.S. Cl. ..... 173/160; 173/43

[51] Int. Cl.[2] ..... E21C 5/02

[58] Field of Search ..... 173/43, 152, 160; 408/132, 133, 134; 74/841; 92/51; 91/167 R

[56] References Cited

UNITED STATES PATENTS

| | | | |
|---|---|---|---|
| 478,266 | 7/1892 | Synon | 74/841 |
| 3,247,913 | 4/1966 | Hällberg et al. | 173/160 X |
| 3,256,943 | 6/1966 | Lindgren | 173/43 |
| 3,692,124 | 9/1972 | Kimber | 173/160 |
| 3,744,575 | 7/1973 | Strommes | 173/43 |
| 3,807,510 | 4/1974 | Boom et al. | 173/160 |
| 3,896,887 | 7/1975 | Council | 173/43 |

*Primary Examiner*—Ernest R. Purser
*Assistant Examiner*—William E. Pate, III
*Attorney, Agent, or Firm*—Michael E. Martin

[57] ABSTRACT

A rock drill feed shell is slidably mounted on a support bracket and is connected to a feed screw which is threaded through a feed nut mounted on an elongated supporting tube disposed telescopically within the feed shell. The supporting tube is displaceable with respect to the support bracket by a feed extension cylinder mounted on the support bracket. A rock drill is slidably mounted on the feed shell and engages a second feed screw supported by the feed shell. A feed motor is drivably connected to both screws.

6 Claims, 6 Drawing Figures

ROCK DRILL FEED MECHANISM

This is a continuation of application Ser. No. 479,913, filed June 17, 1974.

BACKGROUND OF THE INVENTION

The present invention is an improvement in rock drill feed mechanisms of the type which may be extended to accommodate sectional drill steels of one length for drilling relatively long holes and then collapsed or telescoped for using shorter drill steels for drilling in confined areas. Examples of the advantageous use of such feed mechanisms would include drilling a drift or heading at an angle with respect to an existing drift or tunnel, or using the same feed mechanism for drift and stope drilling or roof bolting operations.

Prior art extendable or telescoping feed mechanisms are somewhat cumbersome and unstable when fully extended. Furthermore, it is desirable to achieve as much compactness and reliability in such mechanisms due to the confined operating area and the severe loads and punishment which must be withstood by rock drill feed apparatus. Examples of prior art extendable or telescoping feed mechanisms are disclosed in U.S. Pat. Nos. 3,744,574 and 3,807,510.

The present invention is considered to be an improvement in the art of extendable rock drill feeds in the above respects as well as others which will be appreciated by those skilled in the art.

SUMMARY OF THE INVENTION

The present invention provides an improved rock drill feed mechanism of the extendable or telescoping type wherein a main feed shell or drill motor guideway is mounted directly on a support member disposed on the distal end of a drill boom. With the feed mechanism of the present invention an intermediate feed member or guideway is not required to bear the weight of the drill motor and feed shell therefor.

The present invention also provides an improved feed mechanism of the extendable type wherein power means for extending the drill motor feed shell is disposed in a protected way within the feed shell and is therefore less susceptible to damage from the severe operating environment normally encountered with rock drilling apparatus.

The present invention further provides for an extendable rock drill feed mechanism which is operated by a pair of power screws for feeding the drill motor along the feed shell and for displacing the feed shell with respect to a support bracket, respectively. The power screws can be geared for rotation together or the screw for displacing the feed shell can be rendered inoperative to prevent displacement of the feed shell with respect to an intermediate feed extension member.

DESCRIPTION OF THE PREFERRED EMBODIMENTS

Figure 2:
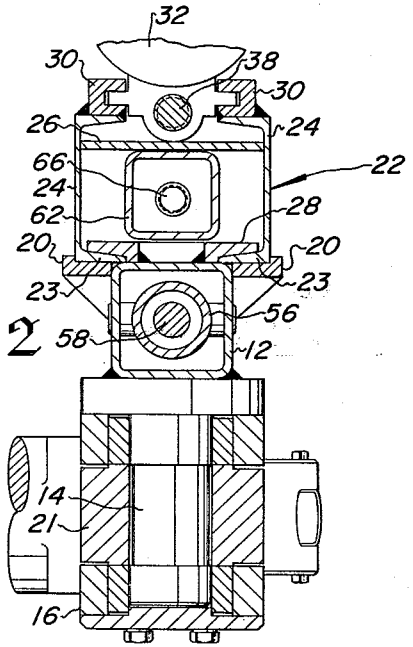
FIG. 2 is a transverse section view taken along line 2—2 of FIG. 1.

Referring to FIGS. 1 through 5, a rock drill feed mechanism in accordance with the present invention is illustrated and generally designated by the numeral 10. The feed mechanism 10 includes a support bracket characterized by a tubular member 12 and a trunnion 14 which is rotatably mounted on a positioner member 16. The positioner 16 is attached to the distal end of a movable boom 18 in a conventional manner. This arrangement provides for positioning the feed mechanism 10 in a wide range of positions and directional attitudes in accordance with the mounting arrangement of the boom itself and the specific construction of the positioner 16. The positioner 16 includes a pair of pressure fluid cylinder actuators 17 and 19 for pivotally moving a bracket 21 which is suitably keyed to the trunnion 14. Referring particularly to FIG. 2, a pair of elongated parallel guides 20 are formed as part of the support bracket 12 for slidably supporting an elongated feed shell 22. The feed shell 22 comprises a pair of opposed inwardly facing channel members 24 secured together by suitable means including a transverse plate 26. The lower flanges 23 of the channel members 24 are slidable on the guides 20 and are retained in guideways formed by the guides 20 and a flanged retainer plate 28 secured on the support bracket 12. The feed shell 22 includes spaced apart guideways 30 for guiding a percussion rock drill motor 32 for sliding movement along the feed shell. The drill motor 32 is operable to transmit rotation and impact blows to a drill rod 34 having a bit portion 36 attached to the distal end thereof.

The feed shell 22 includes means mounted thereon for advancing and retracting the drill motor along the feed shell, said means comprising an elongated power screw 38 rotatably supported on the feed shell between the guideways 30. The screw 38 is threadedly engaged with a cooperating nut 40 disposed on the drill motor 32 whereby in response to rotation of the screw the drill motor may be moved along the feed shell. The feed mechanism 10 includes suitable fluid motor means 42 disposed at one end of the feed shell 22 and having an output shaft 44 drivably connected to the rotatable screw 38 by a suitable coupling member 46. The coupling member 46 is disposed in a housing 48 fastened to the feed shell 22. The coupling member 46 also comprises a gear which is drivably meshed with a gear 50 rotatably mounted in the housing 48. A disengageable clutch is formed by a member 52 which cooperates with suitable clutch dogs 53 formed on gear 50. The member 52 is keyed for rotation with a shaft portion 67 but is axially slidable with respect to the shaft. The member 52 further includes an actuating knob 54 projecting from the housing 48 whereby the member 52 may be longitudinally moved in and out of driving engagement with the gear 50.

The feed mechanism 10 comprises means for longitudinally displacing the feed shell 22 with respect to the support bracket 12 which means is characterized by a pressure fluid cylinder and piston assembly 56 disposed within the tubular member 12. One end of the cylinder 56 is suitably connected to the tubular member 12 and the distal end of a piston rod 58 of the cylinder 56 is connected to a bracket 60, see FIG. 3, which is slidably mounted on the flanges 23 of the feed shell 22. The aforementioned means for displacing the feed shell 22 with respect to the support bracket 12 further comprises an elongated tube 62 fixed to the bracket 60 and disposed telescopically within the feed shell between the channel members 24. One end of the tube 62 includes a nut 64 mounted thereon and threadedly connected to a cooperating screw 66 one end of which includes the shaft portion 67 rotatably disposed in the housing 48. The screw 66 extends through the nut 64 into the tube 62 and is longitudinally nondisplaceable with respect to the feed shell 22. In response to being rotatably driven by the motor 42 by way of gears 46 and 50 the screw 66 is operable to cause the feed shell 22 to be moved along the support bracket 12. Moreover, apart from the advancing and retracting movement of the feed shell 22 caused by rotation of the screw 66 the cylinder 56 may be actuated to extend or retract the piston rod 58 for moving the tube 62 and the feed shell along the tubular support bracket 12.

Figure 1:
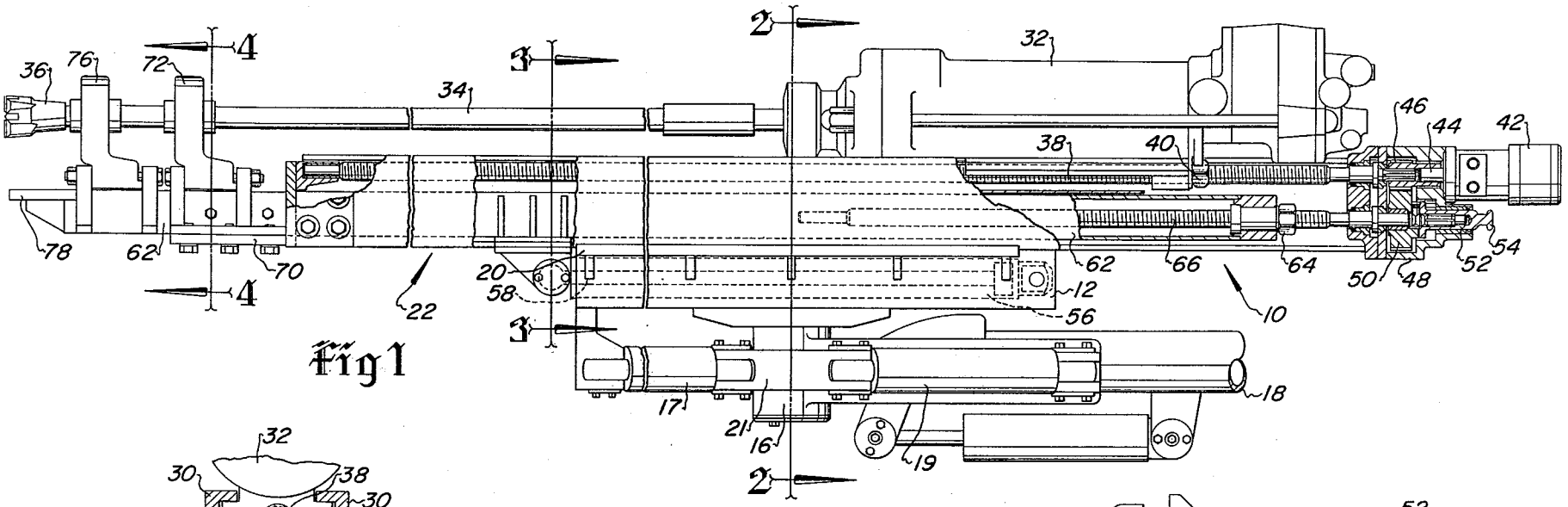
FIG. 1 is a longitudinal side elevation of the extendable feed mechanism of the present invention.
Figure 5:
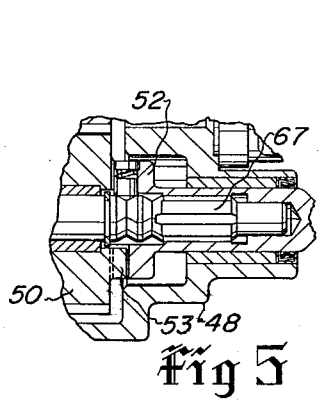
FIG. 5 is a fragmentary section view of the clutch-coupling mechanism for engaging the second feed screw; and, FIG. 6 is a longitudinal side elevation of an alternate embodiment of the present invention.
Figure 4:
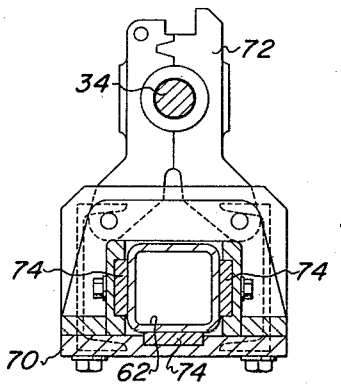
FIG. 4 is a transverse section view taken along line 4—4 of FIG. 1.
Figure 3:
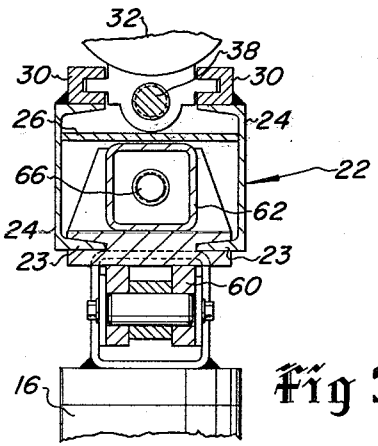
FIG. 3 is a transverse section view taken along line 3—3 of FIG. 1.

The forward end of the feed shell 22 has fastened thereto a support member 70 for a drill rod centralizer 72. Referring to FIG. 4 the support member 70 includes bearing pads 74 disposed thereon for supporting engagement with the tube 62. The tube 62 extends through the support member 70 and includes a second drill rod centralizer 76 mounted on its forwardly projecting end portion. A suitable stabilizer 78 is also mounted to project forwardly from the end of the tube 62 for engagement with a rock face to be penetrated by the bit 36.

If it is desired to use the maximum feed length of the feed mechanism 10 the boom 18 would normally be positioned to permit maximum extension of the piston rod 58 of the cylinder 56 while also allowing the stabilizer 78 to engage the rock face to be drilled. The motor 42 would then be actuated to move the feed shell 22 rearwardly away from the stabilizer 78 by rotating the screw 66 until it is extended rearwardly as far as possible without disengagement from the nut 64. The drill motor 32 would necessarily need to be advanced far enough forwardly on the feed shell 22 at the onset of the above described extension of the screw 66 to permit full extension of the screw before the drill motor reached its rearward limit position on the feed shell. After full rearward extension of the screw 66 the clutch member 52 could be disengaged from gear 50, if necessary, to render the screw 66 inoperable while continuing the rotation of screw 38 to move the drill motor to its rearward limit position. In fact, the drill motor 32 could be initially positioned on the feed shell in such a way that it would engage the housing 48 on moving rearwardly before the screw 66 became disengaged from the nut 64. The feed mechanism 10 would now be in its maximum extended condition thereby permitting the use of drill rods of a predetermined length. Forward feeding of the drill motor 32 would normally be accomplished by operation of the motor 42 with the clutch member 52 in the engaged position to rotate both screws 38 and 66 simultaneously to advance the drill motor along the feed shell 22 and advance the feed shell itself along the support bracket 12 until the forward limit position of the drill motor and the feed shell were reached. Proper selection of the number of teeth in gears 46 and 50 or of the thread lead of the screws 38 and 66, or a predetermined combination of the two can provide for the drill motor 32 and the feed shell 22 reaching their forward limit positions simultaneously.

For example, if the maximum traversal of the drill motor 32 along the feed shell 22 is twice the maximum traversal of the screw 66 with respect to the nut 64 the number of teeth in gear 50 would be selected to be twice the number of teeth in gear 46, assuming that the thread lead of screws 38 and 66 was the same.

For operation of the feed mechanism in the telescoped or shortest feed length condition the screw 66 would be advanced into the tube 62 to the forward limit position and the clutch member 52 would then be disengaged to render the screw 66 inoperative. The effective feed length of the feed mechanism 22 would then be that which may be accomplished by operation of the motor 42 to rotate the feed screw 38 for feeding the drill motor 32 along the feed shell 22 plus the extension of the cylinder 56.

Figure 6:
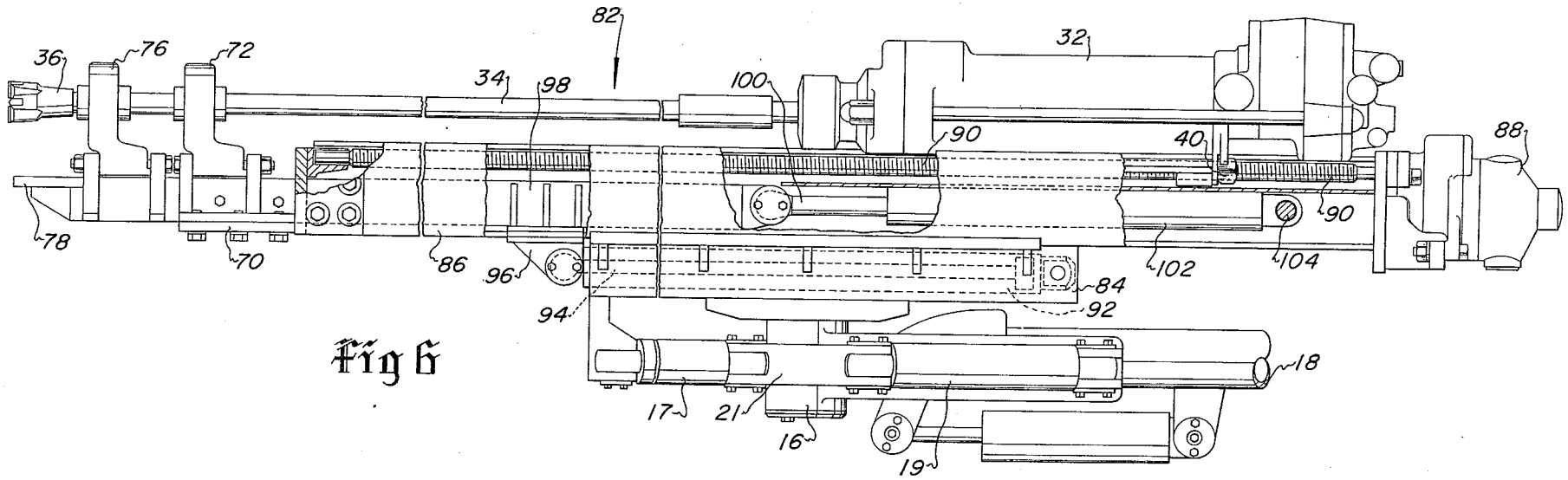

Referring to FIG. 6, an alternate embodiment of the feed mechanism of the present invention is illustrated and generally designated by the numeral 82. The feed mechanism 82 includes a support bracket 84 and a feed shell 86 slidably mounted thereon, both members being similar respectively to the support bracket 12 and feed shell 22 of the mechanism 10 illustrated in FIGS. 1 through 5. The feed shell 86 has a motor 88 mounted on the rearward end thereof which is suitably drivably engaged with an elongated feed screw 90. The screw 90 is rotatably supported on the feed shell 86 in a manner similar to the way in which screw 38 is supported on feed shell 22. The drill motor 32 is slidably mounted on the feed shell 86 and the nut 40 is threadedly engaged with the screw 90.

The feed mechanism 82 is further characterized by a pressure fluid linear extension cylinder 92 which is mounted on the support bracket 84 and has a piston rod 94 extending forwardly and connected to a bracket 96. An elongated tubelike member 98 is secured to the bracket 96 and is disposed telescopically within the feed shell 86. The member 98 includes a drill rod centralizer 76 mounted thereon and adjacent to a stabilizer 78 which is secured to the distal end of the member 98. The opposite end of member 98 is connected to the piston rod 100 of a pressure fluid extension cylinder 102 which is disposed within the feed shell 86 between the respective channel members thereof. The cylinder 102 is connected to the feed shell 86 by a pin 104. Accordingly, the feed shell 86 can be displaced with respect to the support bracket 84 by actuation of the cylinders 92 and 102 to extend or retract the effective feed length of the mechanism 82. The cylinders 92 and 102 may be actuated by suitable fluid controls disposed remote from the feed mechanism itself and the cylinder 92 and 102 may be actuated to advance or retract the feed shell 86 with respect to a work face independently of actuation of the motor 88 and feed screw 90.

What is claimed is:

1. A rock drill feed mechanism comprising:

an elongated feed shell;

a support for said feed shell including guide means for engaging said feed shell for guiding said feed shell for linear movement in opposite directions along said support;

a rock drill slidably mounted on said feed shell;

first means mounted on said feed shell and connected to said rock drill for feeding said rock drill along said feed shell in opposite directions;

a member disposed on said feed shell for linear telescoping movement with respect to said feed shell;

a pressure fluid cylinder actuator interconnecting said member and said support; and, second means interconnecting said member and said feed shell for moving said feed shell linearly along said support in response to the operation of said pressure fluid cylinder actuator, said second means being operable to move said feed shell linearly along said support and with respect to said member.

2. The invention set forth in claim 1 wherein:

said first means comprises a first power screw mounted on said feed shell and engaged with a cooperating nut mounted on said rock drill.

3. The invention set forth in claim 2 wherein:

said second means comprises a second power screw operatively connected to said feed shell and said member.

4. The invention set forth in claim 3 wherein:

said second power screw is rotatably supported at one end on said feed shell and said second power screw is engaged with a cooperating nut mounted on said member.

5. The invention set forth in claim 4 wherein:

said first power screw is rotatably mounted on said feed shell and is drivably connected to motor means mounted on said feed shell.

6. The invention set forth in claim 2 wherein:

said second means comprises extensible pressure fluid cylinder and piston means.

* * * * *